US007758207B1

(12) United States Patent
Zhou et al.

(10) Patent No.: US 7,758,207 B1
(45) Date of Patent: Jul. 20, 2010

(54) LIGHTWEIGHT LED LAMP

(75) Inventors: Qin-Fei Zhou, Shenzhen (CN); Yong-Dong Chen, Shenzhen (CN); Shih-Hsun Wung, Taipei Hsien (TW)

(73) Assignees: Fu Zhun Precision Industry (Shen Zhen) Co., Ltd., Shenzhen, Guangdong Province (CN); Foxconn Technology Co., Ltd., Tu-Cheng, Taipei Hsien (TW)

( * ) Notice: Subject to any disclaimer, the term of this patent is extended or adjusted under 35 U.S.C. 154(b) by 0 days.

(21) Appl. No.: 12/504,680

(22) Filed: Jul. 17, 2009

(30) Foreign Application Priority Data

Mar. 17, 2009 (CN) ..... 200910300891

(51) Int. Cl.
*F21V 29/00* (2006.01)

(52) U.S. Cl. ..... 362/218; 362/249.02; 362/800; 362/225; 362/217.1

(58) Field of Classification Search ..... 362/249, 362/800, 218, 294, 373, 249.1, 247, 217.01, 362/217.02, 217.05, 225, 217.1, 217.11, 362/217.12, 217.13
See application file for complete search history.

(56) References Cited

U.S. PATENT DOCUMENTS

| | | | | |
|---|---|---|---|---|
| 6,882,111 | B2 * | 4/2005 | Kan et al. | 315/122 |
| 7,331,689 | B2 * | 2/2008 | Chen | 362/240 |
| 2006/0146531 | A1 * | 7/2006 | Reo et al. | 362/244 |
| 2007/0285930 | A1 * | 12/2007 | Chen | 362/373 |
| 2008/0080189 | A1 * | 4/2008 | Wang | 362/294 |
| 2008/0089071 | A1 * | 4/2008 | Wang | 362/294 |
| 2008/0158856 | A1 * | 7/2008 | Shen | 362/84 |

* cited by examiner

*Primary Examiner*—Laura Tso
(74) *Attorney, Agent, or Firm*—Frank R. Niranjan

(57) ABSTRACT

An LED lamp comprises two spaced elongated side plates, a heat conducting base plate, an LED module, two reflecting plates, a suspension member and an envelope. The base plate is transversely disposed between the two side plates. The LED module is mounted on a bottom surface of the base plate. Two reflecting plates are located below the base plate and attached to the two side plates, respectively, to thereby reflect light generated by the LED module. The suspension member engages with upper portions of the two side plates. The envelope engages with two lower portions of the two side plates to allow light generated by the LED module to radiate therethrough.

19 Claims, 4 Drawing Sheets

LIGHTWEIGHT LED LAMP

BACKGROUND

1. Technical Field

The disclosure relates to a light emitting diode (LED) lamp and, particularly, to a lightweight LED lamp.

2. Description of Related Art

As highly effective light sources, LED lamps are widely used in various fields. An LED lamp includes a number of LEDs, and most of the LEDs are driven at the same time, which results in a quick rise in temperature of the LED lamp. Generally, the LED lamp utilizes a heat sink to dissipate heat generated by the LEDs.

A conventional LED lamp includes a heat sink, a number of LED modules mounted on the heat sink, and a frame holding the heat sink and the LED modules therein. Each of the LED modules includes a LED and a reflector cooperated therewith. Generally, the frame, the heat sink and the reflector each are made of metal, and therefore the LED lamp may have a heavy weight and high manufacture cost.

What is needed, therefore, is a lightweight LED lamp which can overcome the described limitations.

BRIEF DESCRIPTION OF THE DRAWINGS

Many aspects of the present apparatus can be better understood with reference to the following drawings. The components in the drawings are not necessarily drawn to scale, the emphasis instead being placed upon clearly illustrating the principles of the present apparatus. Moreover, in the drawings, like reference numerals designate corresponding parts throughout the several views.

DETAILED DESCRIPTION

Figure 1:
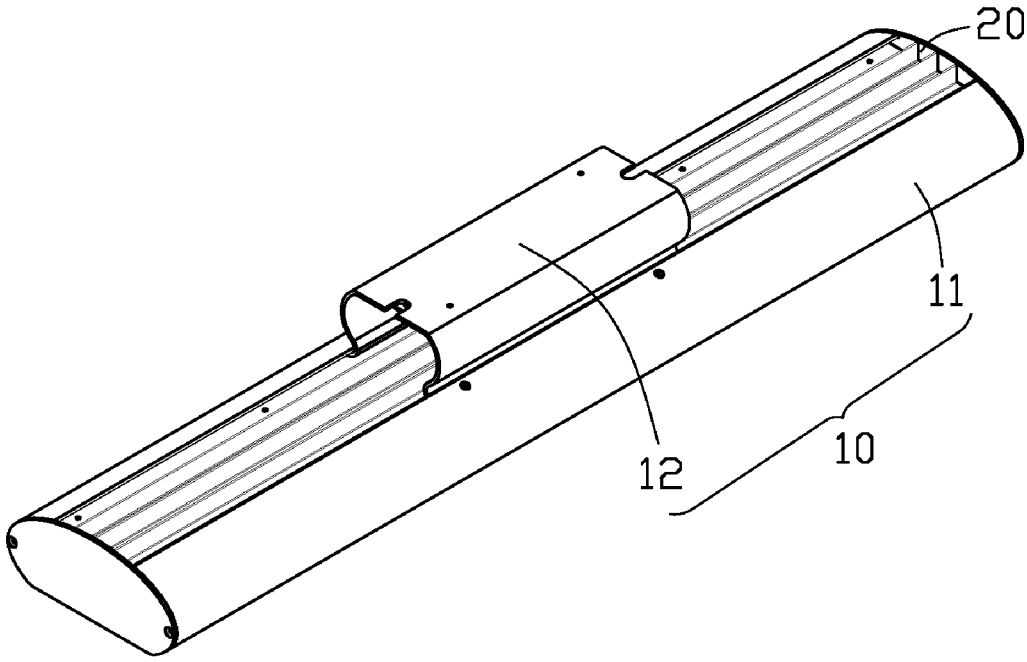
FIG. 1 is an assembled view of an LED lamp in accordance with an embodiment of the disclosure.
Figure 2:
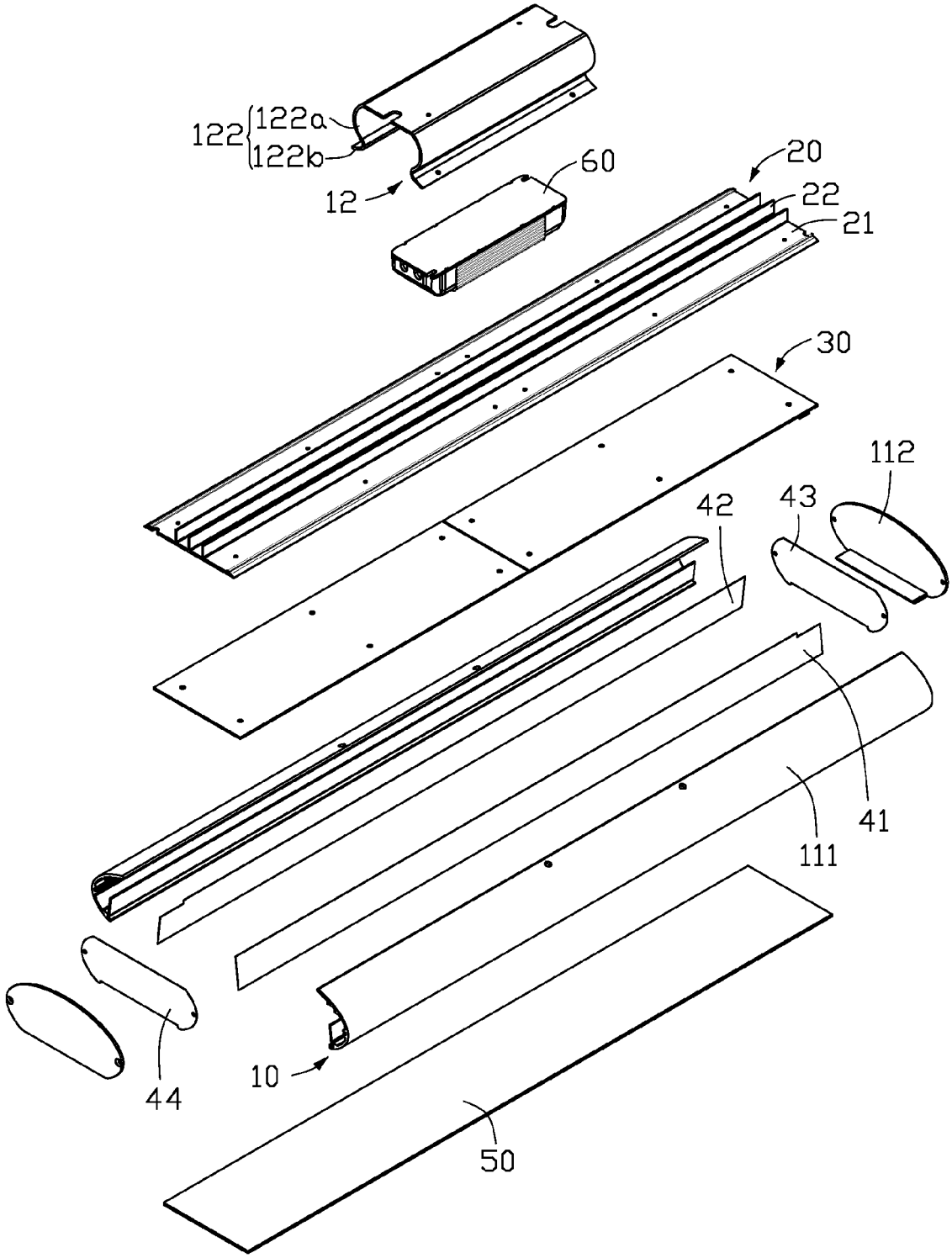
FIG. 2 is an isometric, exploded view of the LED lamp of FIG. 1.
Figure 3:
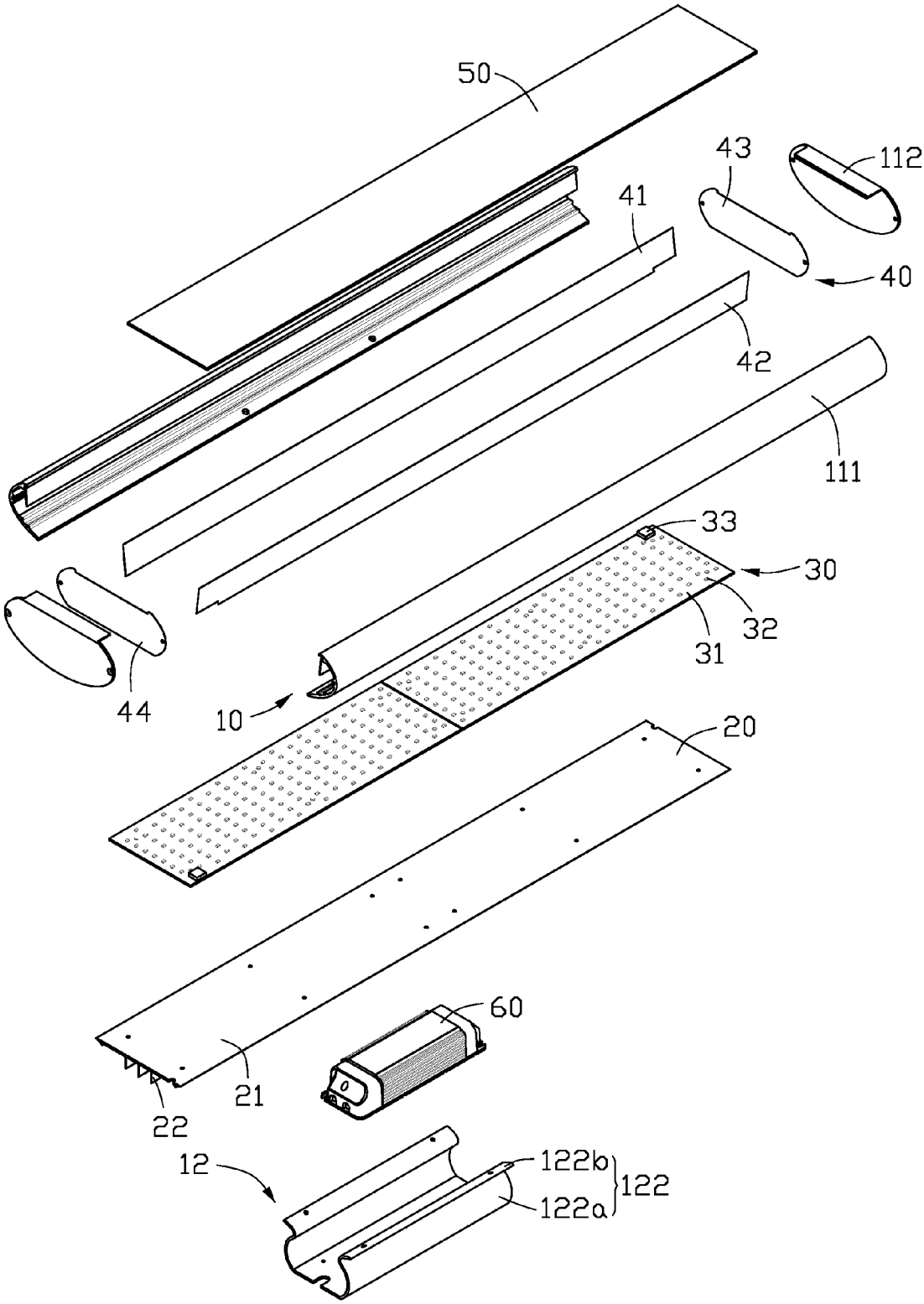
FIG. 3 is an inverted view of FIG. 2.
Figure 4:
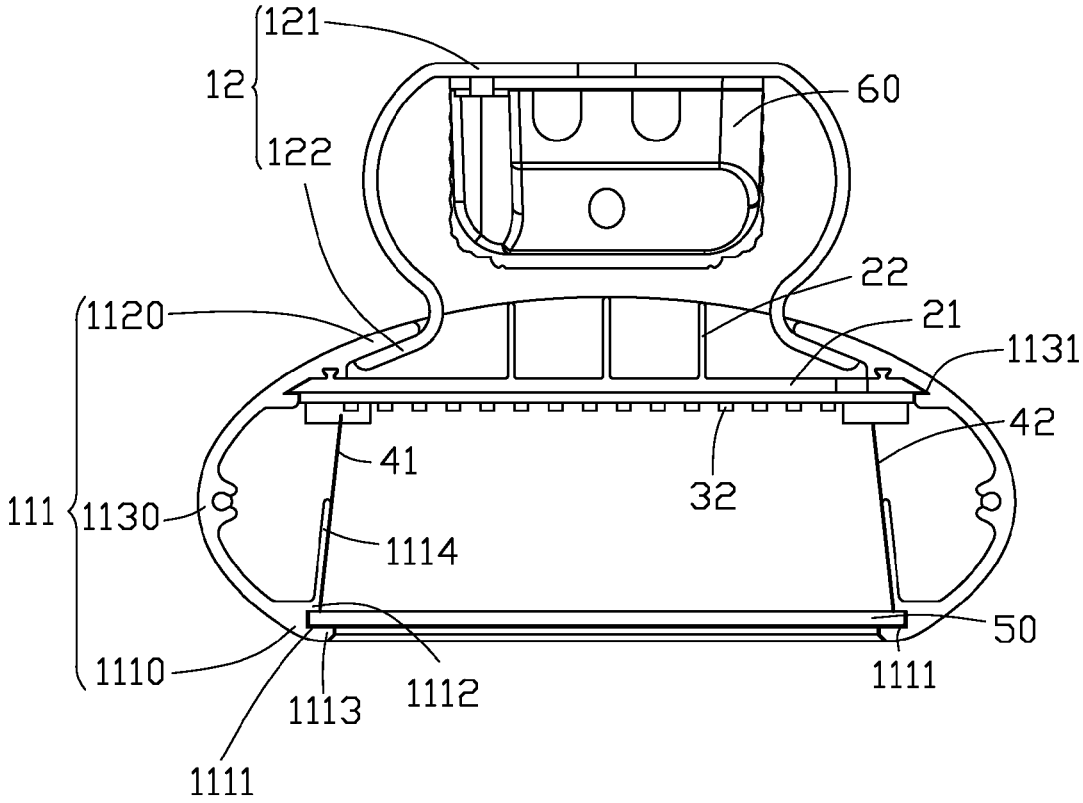
FIG. 4 is an enlarged, cross-sectional view of the LED lamp of FIG. 1.

Referring to FIGS. 1-3, an LED lamp includes a frame 10, a heat sink 20, an LED module 30, a reflection module 40, an envelope 50 and a power module 60.

The frame 10 includes an elongated holding member 11 and a suspension member 12 engaged with the holding member 11. The holding member 11 includes two elongated side plates 111 and two baffling plates 112. The two side plates 111 are arc-shaped structures and are spaced at a distance with two openings thereof facing to each other. Each of the two baffling plates 112 has a sheet-like structure, and is disposed at one of two opposite ends of the two side plates 111 to interconnect the two side plates 111. In this manner, the two side plates 111 and the two baffling plates 112 cooperatively form an illumination chamber, i.e., the holding member 11.

The two side plates 111 each are made of plastic material and manufactured by plastic extrusion. Each of the two side plates 111 includes an elongated lower fixing portion 1110, an elongated upper fixing portion 1120 and a connection portion 1130 connected between the lower fixing portion 1110 and the upper fixing portion 1120. The lower fixing portion 1110 is configured for engaging with the envelope 50, and the upper fixing portion 1120 is configured for engaging with the suspension member 12. A first ridge 1112 and a second ridge 1113 protrude from an inner surface of the lower fixing portion 1110 and define a groove 1111 therebetween. The groove 1111 extends along a lengthwise direction of the lower fixing portion 1110, and receives one of two opposite lateral sides of the envelope 50 to secure the envelope 50 between the two lower fixing portions 1110 of the two side plates 111. The first ridge 1112 extends upwardly and inwardly to form an extension plate 1114 supporting the reflecting module 40 thereon.

The connection portion 1130 defines an elongated slot 1131 near the upper fixing portion 1120 for receiving one of two opposite lateral sides of the heat sink 20. The heat sink 20 includes a heat conducting base plate 21 and a plurality of fins 22 extending upwardly from a top surface of the base plate 21. The base plate 21 is a rectangular metallic plate, and two longer edges of the base plate 21 are received in the two slots 1131 of the connection portions 1130 of the two side plates 111, respectively, whereby the heat sink 20 is fixed between the two side plates 111. A distance between the two side plates 111 can be adjusted according to a width of the base plate 21 of the heat sink 20. Thus, the two side plates 111 can accommodate various heat sinks 20 with various sizes to thereby construct various LED lamps.

The LED module 30 includes a rectangular base board 31 mounted on a bottom surface of the base plate 21 of the heat sink 20, and a plurality of LEDs 32 mounted on a bottom surface of the base board 31. Structure and size of the base board 31 of the LED module 30 are similar to those of the base plate 21 of the heat sink 20. Wire circuit (not shown) is laid on the bottom surface of the base board 31, and two connection terminals 33 arranged at two diagonal corners of the bottom surface of the base board 31, respectively, to electrically connect the wire circuit with a power supply, whereby the LEDs 32 can be powered to lighten.

The reflecting module 40 is used to reflect light emitted from the LED module 30, and guides the light to travel in a desired light emission direction. The reflecting module 40 is located below the bottom surface of the base plate 21 of the heat sink 20 and includes a first reflecting plate 41 and a second reflecting plate 42 respectively attached to the two side plates 111 and extending along the lengthwise direction of the two side plates 111. In detail, the first and second reflecting plates 41, 42 are adhered to inner surfaces of the two extension plates 1114, respectively, by an adhesive. A lower part of the first reflecting plate 41 abuts the inner surface of the extension plate 1114 of the lower fixing portion 1110 of one side plate 111, and an upper edge of the first reflecting plate 41 contacts the base board 31 of the LED module 30. Similarly, the second reflecting plate 42 is secured to another side plate 111 and an upper edge thereof contacts the base board 31 of the LED module 30. Thus, no gap exists between the first reflecting plate 41 and the base board 31 and between the second reflecting plate 42 and the base board 31 of the LED module 30, whereby light emitted from the LED module 30 can be sufficiently reflected by the reflecting plates 41, 42. That is, all light emitted from the LED module 30 can be effectively reflected by the first and second reflecting plates 41, 42, thereby improving an utilization efficiency of the light generated by the LED module 30.

Preferably, the reflecting module 40 includes two side reflecting plates 43, 44 disposed between the first and second reflecting plates 41, 42 and adhered to inner sides of the two baffling plates 112, respectively, by an adhesive. Similarly, no gap exists between each of the two side reflecting plates 43 and the base board 31 of the LED module 30, whereby light emitted from the LED module 30 cannot escape from the gap and is sufficiently reflected by the two side reflecting plates 43. According to such arrangement, the first and second reflecting plates 41, 42 and the two side reflecting plates 43, 44 surround and face the LED module 30, so as to effectively reflect light emitted from the LED module 30. The first and second reflecting plates 41, 42 and the two side reflecting plates 43, 44 are made of plastic material such as polycarbonate (PC) resin.

The suspension member 12 is made of plastic material and manufactured by extrusion. The suspension member 12 has an inverted U-shaped configuration and includes a securing panel 121 and two engaging walls 122 extending downwardly from two opposite lateral sides of the securing panel 121. The power module 60 is fixed to the securing panel 121 and arranged between the two engaging walls 122. Each of the two engaging walls 122 includes an arc body 122*a* connected to the securing panel 121 and a coupling plate 122*b* extend outwardly from a free, lower end of the body 122*a*. The two coupling plates 122*b* of the two engaging walls 122 are located between the two upper fixing portions 1120 of the two side plates 111. Outer surfaces of the two coupling plates 122*b* of the two engaging walls 122 are fixed to inner surfaces of the two upper fixing portions 1120 of the two side plates 111, respectively. The suspension member 12 is used to engage with a bottom end of a fixture (not shown) which has a top end secured to a ceiling, for example, to enable the LED lamp to hang and lighten a space below the ceiling.

In assembly, the suspension member 12 is secured to the holding member 11 by fixing the two coupling plates 122*b* of the two engaging walls 122 to the upper fixing portions 1120 of the two side plates 111, respectively. The two longer edges of the base plate 21 of the heat sink 20 slide into the two slots 1131 of the connection portions 1130 of the two side plates 111, along the lengthwise direction thereof, whereby the heat sink 20 is fixed between the two side plates 111. The LED module 30 is mounted on the bottom surface of the base plate 21 of the heat sink 20, and the two baffling plates 112 are secured to the two opposite ends of the two side plates 111. The first and second reflecting plates 41, 42 are adhered to the inner surfaces of the two extension plates 1114 of the lower fixing portions 1110 of the two side plates 111, respectively, and the two side reflecting plates 43, 44 are adhered to the inner sides of the two baffling plates 112, respectively. The two lateral sides of the envelope 50 are received in the two grooves 1111 of the two lower fixing portions 1110 of the two side plates 111. The power module 60 is fixed on the top surface of the securing panel 121 of the suspension member 12. After the LED lamp is assembled, the LED module 30 and the reflection module 40 are received in the frame 10 and located above the envelope 50, whereby light generated by the LED module 30 can radiate downwards through the envelope 50 to lighten a space below the LED lamp.

Regarding the LED lamp, the frame 10, the reflection module 40 and the envelope 50 are made of nonmetallic material, and only the heat sink 20 is made of metallic material. Thus, a weight of the LED lamp is greatly reduced, in comparison with the conventional LED suspension lamp. In addition, the side plates 111 can cooperate with various heat sinks 20 to construct various LED lamps via changing the distance between the side plates 111, whereby a manufacture cost of the LED lamp can be lowered.

It is to be understood, however, that even though numerous characteristics and advantages of the present embodiments have been set forth in the foregoing description, together with details of the apparatus and function of the embodiments, the disclosure is illustrative only, and changes may be made in detail, especially in matters of shape, size, and arrangement of parts within the principles of the embodiments to the full extent indicated by the broad general meaning of the terms in which the appended claims are expressed.

The invention claimed is:

1. An LED lamp comprising:

a holding member comprising two elongated side plates spaced at a distance, each of the two side plates comprising an upper fixing portion, a lower fixing portion and a connection portion connected between the upper and lower fixing portions;

a heat sink comprising a base plate, two edges of the base plate engaging with two connection portions of the two side plates, respectively;

an LED module mounted on a bottom surface of the base plate of the heat sink;

a reflection module located below the base plate of the heat sink to reflect light generated by the LED module;

a suspension member engaging with the two upper fixing portions of the two side plates; and an envelope engaging with the two lower fixing portions of the two side plates to allow light generated by the LED module to radiate therethrough.

2. The LED lamp of claim 1, wherein the two side plates are made of extruded plastic.

3. The LED lamp of claim 2, wherein the suspension member is made of extruded plastic.

4. The LED lamp of claim 3, wherein the suspension member has an inverted U-shaped configuration and comprises a securing panel and two engaging walls extending downwardly from two ends of the securing panel, the two engaging walls engage with the two upper fixing portions of the two side plates, respectively.

5. The LED lamp of claim 4, wherein each of the two engaging walls includes an arc body connected to the securing panel and a coupling plate extending outwardly from a free, lower end of the body, outer surfaces of two coupling plates of the two engaging walls are fixed to inner surfaces of the two upper fixing portions of the two side plates, respectively.

6. The LED lamp of claim 4, wherein the connection portion of each of the two side plates defines an elongated slot, the two edges of the base plate of the heat sink are slidably inserted in the two slots of the two connection portions of the two side plates, respectively, along an extending direction of the slots.

7. The LED lamp of claim 4, wherein the two lower fixing portions of the two side plates define two grooves facing each other and receive two opposite lateral sides of the envelope, respectively.

8. The LED lamp of claim 4, wherein the reflection module comprises two elongated reflecting plates attached to the two side plates, respectively.

9. The LED lamp of claim 8, wherein an extension plate extends upwardly and inwardly from the lower fixing portion of each of the two side plates, and one of the reflecting plates is attached to the extension plate.

10. The LED lamp of claim 9, wherein a lower part of one of the reflecting plate is attached to the extension plate, and an upper edge of the reflecting plate contacts with the bottom surface of the base plate of the heat sink.

11. The LED lamp of claim 1, wherein a plurality of fins protrudes upwardly from a top surface of the base plate of the heat sink.

12. The LED lamp of claim 8, further comprising two baffling plates located at two opposite ends of the two side plates, respectively.

13. The LED lamp of claim 12, further comprising two side reflecting plates attached to the two baffling plates, respectively.

14. The LED lamp of claim 1, the reflection module is made of polycarbonate resin.

15. An LED lamp comprising:

two spaced elongated side plates;

a heat conducting base plate transversely disposed between the two side plates;

an LED module mounted on a bottom surface of the base plate;

two reflecting plates located below the base plate and attached to the two side plates, respectively, to thereby reflect light generated by the LED module;

a suspension member engaging with upper portions of the two side plates; and an envelope engaging with two lower portions of the two side plates to allow light generated by the LED module to radiate therethrough.

16. The LED lamp of claim 15, the side plates and the suspension member made of extruded plastic.

17. The LED lamp of claim 15, wherein the reflecting plates are made of plastic material.

18. The LED lamp of claim 15, further comprising two baffling plates sandwiching two opposite ends of the two side plates therebetween.

19. The LED lamp of claim 18, further comprises two side reflecting plates attached to the two baffling plates, respectively.

* * * * *